US011279450B2

(12) United States Patent
Sheerer et al.

(10) Patent No.: US 11,279,450 B2
(45) Date of Patent: Mar. 22, 2022

(54) METHODS, APPARATUS, AND SYSTEMS FOR CONNECTING PLURAL STAND-UP PADDLE BOARDS TOGETHER TO FORM AN EXTENDED FLOATING PLATFORM

(71) Applicants: Christian Peter Sheerer, Sunnyvalle, CA (US); Jeffrey Scott Pickles, Sunnyvalle, CA (US)

(72) Inventors: Christian Peter Sheerer, Sunnyvalle, CA (US); Jeffrey Scott Pickles, Sunnyvalle, CA (US)

( * ) Notice: Subject to any disclaimer, the term of this patent is extended or adjusted under 35 U.S.C. 154(b) by 0 days.

(21) Appl. No.: 16/916,030

(22) Filed: Jun. 29, 2020

(65) Prior Publication Data

US 2020/0407027 A1 Dec. 31, 2020

Related U.S. Application Data

(60) Provisional application No. 62/868,879, filed on Jun. 29, 2019.

(51) Int. Cl.

*B63B 32/73* (2020.01)
*B63B 32/40* (2020.01)
*B63B 32/50* (2020.01)

(52) U.S. Cl.

CPC ..... *B63B 32/73* (2020.02); *B63B 32/40* (2020.02); *B63B 32/50* (2020.02)

(58) Field of Classification Search

CPC ..... B63B 35/00; B63B 35/79; B63B 32/00; B63B 32/40; B63B 32/73; B63B 32/50; B63C 1/00; B63C 1/04

USPC ..... 441/74, 75

See application file for complete search history.

(56) References Cited

U.S. PATENT DOCUMENTS

| | | | |
|---|---|---|---|
| 4,459,714 | A | 7/1984 | Lin |
| 5,189,974 | A | 3/1993 | Masters |
| 5,197,404 | A | 3/1993 | Haley et al. |
| 6,805,066 | B2 | 10/2004 | Johnson |
| 8,702,461 | B1 | 4/2014 | d'Offay |
| 8,821,204 | B1 | 9/2014 | Hoge, Jr. |
| 8,834,220 | B2 | 9/2014 | Haller et al. |
| 9,428,253 | B1 | 8/2016 | Morgan et al. |
| 10,293,897 | B2 | 5/2019 | Ruiz |
| 10,526,047 | B2 | 1/2020 | Hopkins |
| 10,633,062 | B2 | 4/2020 | Boonlikitcheva |
| 2003/0153221 | A1 | 8/2003 | Weir |

(Continued)

FOREIGN PATENT DOCUMENTS

| | | | |
|---|---|---|---|
| CA | 2479521 | C | 12/2006 |
| GB | 2180800 | A | 4/1987 |

*Primary Examiner* — Lars A Olson

(74) *Attorney, Agent, or Firm* — Jeffery D. Frazier

(57) ABSTRACT

Embodiments are disclosed of a standup paddle (SUP) board comprising a substantially rectangular shape in outline and having a length dimension that is a whole number multiple of its width dimension. A plurality of link members are disposed at spaced-apart locations along the periphery of the board's deck. Each link member can function, in a first configuration, as a handle for the board; and, in a second configuration, as a linkup for connecting the board in abutting relation to one or more other adjacently located, similarly configured standup paddle boards. With a plurality of such boards connected proximate one another in a desired configuration via such links, an extended upper surface is provided that can serve as a substantially stable platform upon which one or more persons can engage in desired activities.

20 Claims, 4 Drawing Sheets

(56) References Cited

U.S. PATENT DOCUMENTS

| | | | |
|---|---|---|---|
| 2006/0116039 | A1 | 6/2006 | Pole et al. |
| 2019/0308698 | A1 | 10/2019 | Builder et al. |

METHODS, APPARATUS, AND SYSTEMS FOR CONNECTING PLURAL STAND-UP PADDLE BOARDS TOGETHER TO FORM AN EXTENDED FLOATING PLATFORM

RELATED APPLICATION

The present application claims priority to U.S. Provisional Patent Application No. 62/868,879 filed on Jun. 29, 2019; which is incorporated herein by reference in its entirety.

FIELD

The present teachings relate to personal watercraft for use on bodies of water. Particularly, the present teachings relate to stand-up paddle (SUP) boards for use by individuals, alone and in groups, in a range of recreational activities.

INTRODUCTION

Standup paddle boarding has become a popular recreational water sport. People of various ages enjoy this water sport on various bodies of water, such as rivers, lakes, reservoirs, oceans, and the like, and participate in a wide range of activities in addition to paddling, such as fishing, yoga, and socializing, among others. It is common that people enjoy paddle boarding individually (alone) as well as together in groups, e.g., friends and/or families. Regarding the latter, with prior standup paddle boards, there is not an easy and effective way for multiple paddle boarders to transfer items or people from one paddle board to another, or to secure multiple boards together in a manner providing acceptable stability and usefulness of the boards.

Prior standup paddle boards (SUPs) are substantially stable only when a user stands in the middle region of the board. Such prior boards tend to capsize when the user positions himself proximate a lateral edge, nose or tail of the board, or reaches or bends over so as to shift his center of gravity away from the board's center of buoyancy. Often, users must sit down to put their feet in the water to stabilize the board before being able to transfer items or people from one board to another, or simply to rest their legs from prolonged balancing.

There is a need for standup paddle boards which can enhance the social enjoyment of multiple users participating in various activities involving standup paddle boarding.

SUMMARY

An exemplary and non-limiting summary of various embodiments is set forth next.

Various aspects of the present teachings relate to stand-up paddle (SUP) boards. In accordance with various embodiments, for example, a stand-up paddle board of the present teachings can comprise:

(a) an elongate body comprising (i) a perimeter defining a substantially rectangular outline or plane shape comprising a width dimension, W, and a length dimension, L; wherein the length dimension L comprises a whole-number multiple, N, of the width dimension, W; (ii) an upper surface defining a deck; (iii) a bottom defining a hull; and, (iv) an edge extending along each side of the body, between the deck and the hull, defining nose, tail, and right/left lateral side rails;

(b) a connection point pair disposed on the deck comprising first and second connection points separated from one another by a distance D1 and from respective nearest points of the perimeter by a distance D2; wherein distance D1 is about twice distance D2; and, (c) an elongate link member, comprising first and second end regions, with one end region attached at the first connection point and the other end region manually movable by a user between (i) a first position, attached at the second connection point and (ii) a second position extending away from the deck along a line defined by the first connection point and its respective nearest point of the perimeter;

whereby, the elongate link member provides, (i) in its first position, a handle for the board; and, (ii) in its second position, a linkup for connecting the board to an adjacent like or similarly configured stand-up paddle board.

In various embodiments, manual movement by a user of an elongate link member between its first position and its second position can be carried out entirely by hand. In other words, it can comprise a toolless procedure or operation.

In various embodiments, the whole-number multiple N comprises 3, or greater whole number (e.g., 4, 5, 6, etc.). In some embodiments, N is about 3.

In various embodiments, the deck is substantially planar or flat. In some embodiments, the hull is substantially planar or flat.

According to various embodiments, a plurality of connection-point pairs are disposed at regularly spaced locations on peripheral regions of opposing sides of the deck. In various embodiments, one or both of the first and second connection points comprise D-rings. For example, the D-rings can be glued down onto the deck.

According to various embodiments, the link member comprises an elongate strap with one end attached to a female buckle and the other end fit into a cinch-type mating male buckle. In various embodiments, the strap comprises an elongate, flat nylon strap, comprising a breaking strength of at least 250 pounds. The buckles can comprise any suitable material, such as a sturdy plastic material or a metal, such as stainless steel.

In various embodiments, plural link members are provided, with each link member comprising a first end region and a second end region, with at least one end region of each link member attaching to a respective connection point on the deck.

According to various embodiments, the rails include an elongate nose rail, an elongate tail rail, an elongate left lateral side rail, and an elongate right lateral side rail. In various embodiments, the rails are resiliently deformable. According to some embodiments, the rails are at least partially planar or flat in profile.

Further aspects of the present teachings relate to systems for connecting plural stand-up paddle (SUP) boards together to provide an extended upper surface for engaging in one or more activities. According to various embodiments, for example, such a system can comprise: (a) first and second stand-up paddle (SUP) boards, each comprising (i) an elongate body comprising a perimeter defining a substantially rectangular plane shape comprising a width dimension W and a length dimension L, wherein the length dimension L is a whole-number multiple N of the width dimension W; an upper surface defining a deck; a bottom defining a hull; an edge extending along each side of the body, between the deck and the hull, defining rails; and (ii) plural connection-point pairs at spaced-apart locations on the deck, each comprising a first connection point and a second connection point separated from one another by a distance D1 and from respective nearest points of said perimeter by a distance D2;

wherein the distance D1 is substantially twice the distance D2; and (b) plural elongate link members disposed on each board, each comprising first and second end regions, with one end region attachable at a first connection point of a respective connection-point pair and the other end region adapted for manual movement by a user between a first position, attached at a second connection point of the respective connection-point pair, and a second position, extending away from said deck, along a line defined by the first connection point and its respective nearest point of the perimeter; whereby, each elongate link member provides, when in its first position, a handle for the board; and, when in its second position, a linkup for connecting to the other board; and whereby, with the first and second boards disposed adjacent one another in abutting relation and connected together via a plurality of the link members, an extended upper surface is provided that can serve as a substantially stable platform upon which one or more persons can engage in one or more desired activities.

According to various embodiments, the rails include an elongate nose rail, an elongate tail rail, an elongate left lateral side rail, and an elongate right lateral side rail.

In various embodiments, one of the rails of the first board abuts one of the rails of the second board, with the abutment being continuous along at least 90% of the length of the shortest of the two abutting rails. In some embodiments, the abutment is continuous along at least 95% of the length of the shortest of the two abutting rails.

According to various embodiments, each board comprises a whole-number multiple N of about 3.

In various embodiments, the connection points comprise D-rings.

According to various embodiments, each link member comprises an elongate strap comprising one end region attached to a female buckle and the other end region fit into a cinch-type mating male buckle. In various embodiments, each strap comprises an elongate, flat nylon strap, comprising a breaking strength of at least 250 pounds.

In accordance with various embodiments, the extended upper surface is substantially planar or flat surface throughout. In various embodiments, the extended upper surface is substantially continuous throughout. In some embodiments, the extended upper surface includes gaps or voids in no more than about 10% of its surface area. In various embodiments, the extended upper surface includes gaps or voids in no more than about 5% of its surface area. In some embodiments, That is, the extended upper surface is substantially free of gaps or voids within its surface area.

Various embodiments of the present teachings relate to a standup paddle board comprising an outer perimeter defining a substantially rectangular shape and further comprising a length dimension that is a whole number multiple of its width dimension. According to various embodiments, a plurality of elongate link members are disposed at opposed, regularly spaced locations along the lateral side regions of the standup paddle board. In various embodiments, each link member can function, in a first configuration, as a handle for the board; and, in a second configuration, as a linkup for connecting the board to one or more other adjacently located, similarly or like configured standup paddle boards. According to various embodiments, with a plurality of such boards connected in abutting relation to one another in a desired configuration via such links, an extended upper surface is provided that can serve as a substantially stable platform upon which one or more persons can engage in desired activities. Exemplary activities include paddling, sunbathing, cooking, fishing, bird watching, surfing, yoga, dancing, resting, meditation, sailing, scuba diving, snorkeling, spear fishing, photography, hunting, among others.

In various embodiments, the present teachings provide a standup paddle board configurable (i) for paddling individually and (ii) for connecting to one or more additional stand up paddle boards to form a larger floating platform comprising an extended upper surface useful for a wide range of activities. For example, according to various embodiments, the present teachings provide a stand up paddle board configured for ready connection to one or more other stand up paddle boards so as to provide a substantially stable floating platform comprising an extended upper surface defining a desired pattern/shape that is useful for a wide a range of activities, while preserving the fundamental activity of paddling a single stand up paddle board.

In various embodiments, the present teachings provide a standup paddle board comprising a plurality of link members useful, in a first configuration, as handles for carrying, holding, or otherwise manipulating the board and, in a second configuration, for connecting the board to one or more other standup paddle boards that are similarly configured.

In various embodiments of the present teachings, plural link members are provided that can attach to and extend from one board to respective attachment points on one or more adjacently positioned boards to maintain the boards in fixed abutting relation. Such abutting relation can be, for example, side-by-side, end-to-end, side-to-end, or any combination thereof. Moreover, in any such configurations, a board can extend in either a forward direction or an opposite direction. For example, two standup paddle boards can be connected to one other employing plural link members of the present teachings, with one board longitudinally disposed such that its nose points in a North direction and the other board longitudinally disposed such that its nose points in a South (i.e., the opposite) direction.

In various embodiments, a link member in accordance with the present teachings comprises an elongated member, such as a web, line, rod, or the like, characterized by strength in tension sufficient to stabilize the connected boards under a wide range of conditions/forces, as users enjoy the extended upper surface and activity space. In addition to strength in tension, in some embodiments, a link member is further characterized by strength in compression and/or torsion sufficient to stabilize the connected boards under a wide range of conditions/forces.

The length of a standup paddle board, according to various embodiments of the present teachings, comprises a whole-number multiple of its width. For example, in various embodiments, the length of the board measures two (2) times the width of the board, three (3) times the width of the board, four (4) times the width of the board, five (5) times the width of the board, six (6) times the width of the board, or greater whole number (e.g., 7, 8, 9, etc.) times the width of the board. It will be appreciated by those skilled in the art that such configuration employing whole-number multiples of width to length allows for the boards to be interconnected in any desired one of innumerable possible patterns/shapes.

Further features of the present teachings, in accordance with various embodiments, include the integration of various compartments and utility structures. For example, in various embodiments, one or more compartments and/or utility structures are provided to store equipment, food, drinks, safety equipment, electronics, energy storage devices, solar panels, musical performances, propulsion devices, ice, cooking equipment, tools, utensils, and/or trash receptacles, while preserving the ability to engage in (i)

group actives while multiple stand up paddles boards are connected together and (ii) individual paddling and activities when the standup paddle board is not connected to another stand up paddle board.

BRIEF DESCRIPTION OF THE DRAWINGS

These and other aspects and iterations of the present teachings will be discussed with reference to the following exemplary and non-limiting illustrations, in which like elements are numbered similarly, and where.

DESCRIPTION OF VARIOUS EMBODIMENTS

Reference will now be made to various embodiments. While the present teachings will be described in conjunction with various embodiments, it will be understood that they are not intended to limit the present teachings to those embodiments. On the contrary, the present teachings are intended to cover various alternatives, modifications, and equivalents, as will be appreciated by those of skill in the art.

Various aspects of the present teachings provide methods, apparatus, and systems for connecting a plurality of standup paddle boards together to form a floating platform comprising an extended upper surface of a desired overall geometric configuration providing a substantially stable activity space useful for engaging in a wide range of activities.

Figure 1A:
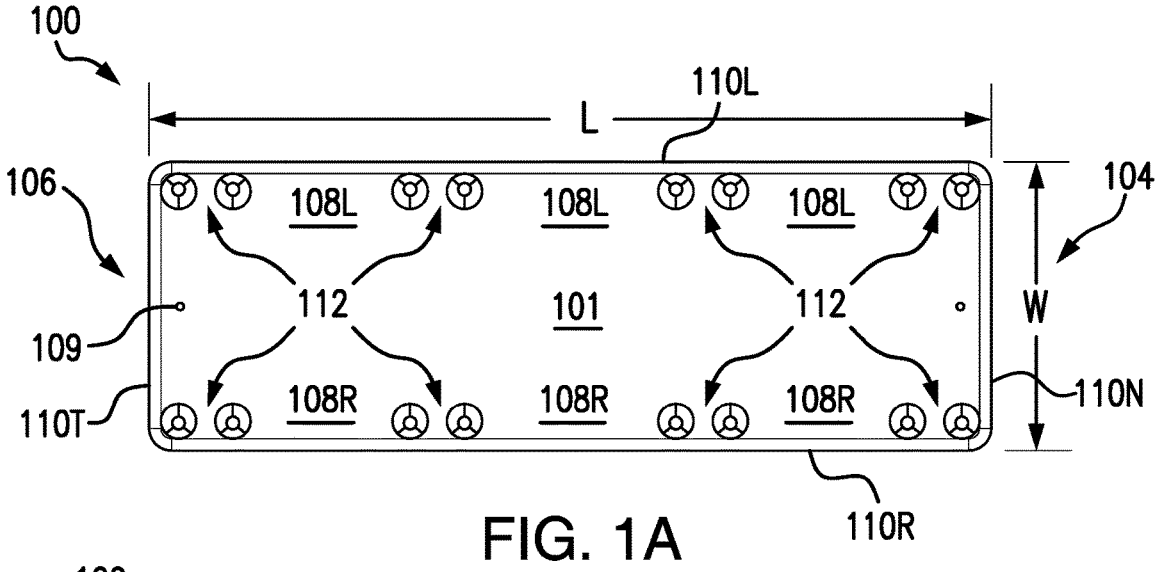
FIGS. 1A-1C schematically illustrate, in top plan, side elevational, and perspective views, respectively, a stand-up paddle board comprising a substantially rectangular main body having a whole-number length-to-width ratio, and eight pairs of connection points disposed at regularly spaced locations along left and right lateral side regions of its deck; in accordance with various embodiments.
Figure 1B:
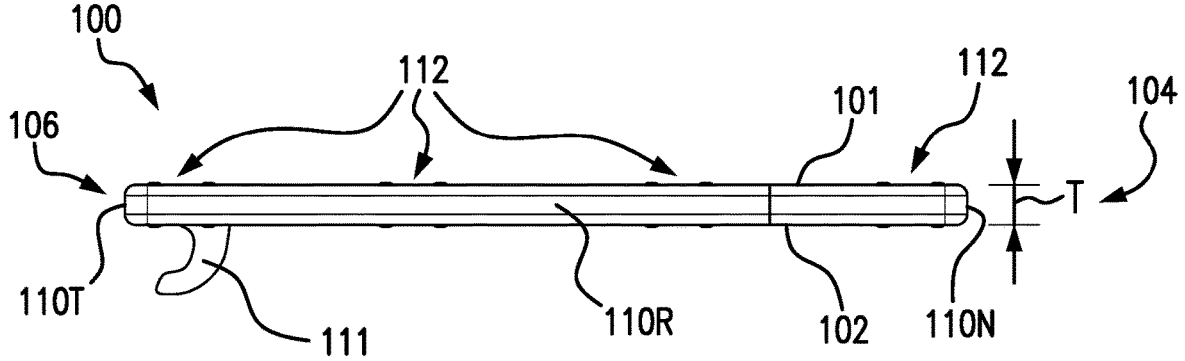
Figure 1C:
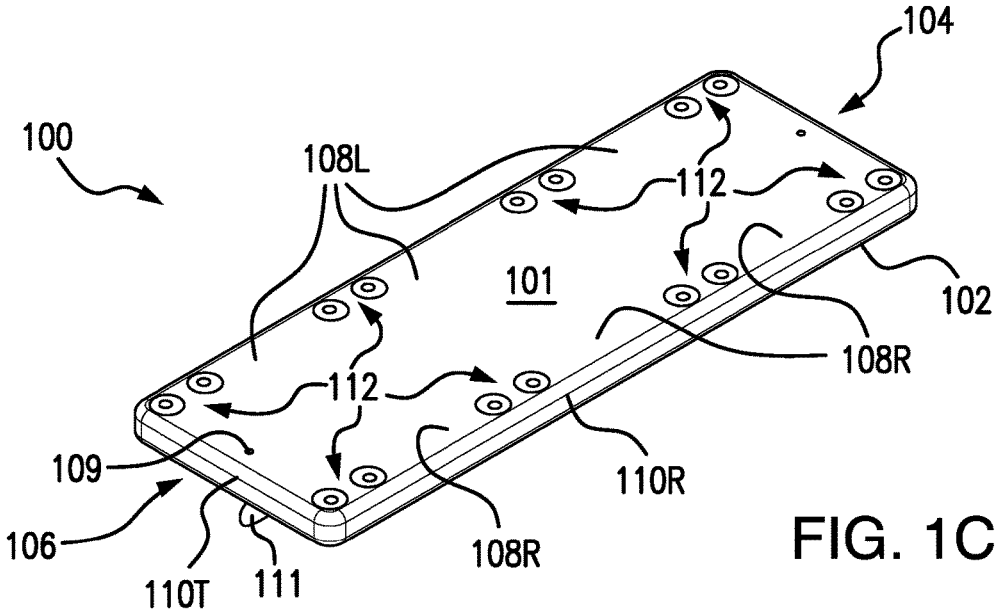

FIGS. 1A-1C schematically illustrate, in top plan, side elevational, and perspective views, respectively, a stand-up paddle board, in accordance with various embodiments of the present teachings. Particularly, a standup paddle (SUP) board, indicated generally at 100, comprises an elongate main body, which includes: a substantially planar upper surface defining a deck 101; a substantially planar underside defining a bottom or hull 102 (FIGS. 1B and 1C); a forwardly-disposed nose region 104; a rearwardly-disposed tail region 106; and, left and right lateral side regions, 108L and 108R, respectively (FIGS. 1A and 1C). A plurality of rails (or edges) span the region between deck 101 and hull 102 along and defining the perimeter of the elongate body; namely: nose and tail cross rails, 110N and 110T, respectively; and, left and right lateral side rails, 110L and 110R, respectively. Overall, the perimeter of standup paddle board 100 comprises a substantially rectangular outline or plane shape.

According to various embodiments, an elongate leash (not shown) can attach via a leash plug in the deck, as at 109 in FIGS. 1A and 1C. In some embodiments, one or more grip or traction pads (not shown) are attached onto at least a portion of the deck. According to various embodiments, one or more bungee cords and/or tie-down straps (not shown) can be attached to the deck, e.g., along its nose region. Attachment can be via any suitable means, such as by hook and loop fasteners, D-rings fastened to the deck, adhesives, or other means known in the art.

In various embodiments, one or more skegs and/or fins can depend from the underside of the elongate body at its tail region, such as fin 111 in FIGS. 1B and 1C, which can be permanently attached or removably attachable to the board, as desired.

While the bottom of the standup paddle board in the depicted embodiment of FIGS. 1A-1C is substantially planar or flat, it is noted that the present teachings contemplate other configurations for the bottom of a standup paddle board, as well. For example, in some embodiments, the bottom of the board comprises a hull configured with a bow and keel adapted to permit the board to faithfully track and travel along a desired direction in use. In various embodiments, for example, a board according to the present teachings omits a fin in favor of a hull configuration that provides for substantially straight travel when paddling in the forward direction, e.g., on a recreational body of water. Various hull designs contemplated for use herein include, for example, a mono hull, a catamaran hull, a trimaran hull, a tunnel hull, and a flat bottom hull. In some embodiments, the bottom of a standup paddle board according to the present teachings is provided with a plurality of elongate grooves or channels extending longitudinally from the nose region to the tail region of the board and configured to impart desired hydrodynamic characteristics to the board when in use.

Further regarding the substantially rectangular outline or plane shape of standup paddle board 100, in the depicted embodiment of FIGS. 1A-1C, the four corners of the board (i.e., where left and right lateral rails 110L, 110R meet nose and tail cross rails 110N, 110T) are provided with a short radius such that each corner is sharply curved or rounded so as not to present a sharp edge. It is noted that the present teachings contemplate other configurations for the corners, as well. For example, in some embodiments, a corner is blunted, e.g., angled at 45° (like a chamfer) or other angle(s) to the adjacent edge surfaces.

With continuing reference to FIGS. 1A-1C, in profile, each rail itself (i.e., 110N, 110T, 110L, and 110R) is sharply curved along its upper and lower regions, proximate deck 101 and bottom 102, respectively, of standup paddle board 100. Along its mid-region, between such sharply curved upper and lower regions, each of rails 110N, 110T, 110L, 110R is more shallowly curved in profile. It is noted that the present teachings contemplate other configurations for the rails, as well. For example, in some embodiments, the rail profile is substantially flat or planar along at least a portion of its environment-facing surface, e.g., along its mid-region. In some embodiments, the rails are fully planar or flat along a majority, or the entirety of their vertical profile, from top to bottom. In various embodiments, the rails comprise a material and/or construction that provides for compliance or resilient deformability.

In accordance with various embodiments, standup paddle board 100 comprises a length (long) dimension, denoted as "L" in FIG. 1A, that is a whole number multiple of its width (short) dimension, denoted as "W" in FIG. 1A. In various embodiments, such whole number multiple can be, for example, two (2), three (3), four (4), five (5), six (6), or greater whole number. In the illustrated embodiment of FIG. 1, such whole number multiple is three (3). In other words, standup paddle board 100, as depicted in FIG. 1, comprises a length-to-width ratio of three-to-one (3:1).

The measured length (L) and width (W) of a substantially rectangular stand-up paddle board in accordance with the present teachings can comprise any suitable distance consistent with the desired use and purpose for the board, provided the desired/selected whole-number length-to-width ratio of the present teachings is maintained. For example, in various embodiments, a stand-up paddle board of the present teachings can comprise a length (L) within a range of from about 70 inches to about 140 inches, from about 90 inches to about 130 inches, or from about 110 inches to about 130 inches. In various embodiments, a stand-up paddle board of the present teachings can comprise a width (W) within a range of from about 20 inches to about 60 inches, from about 30 inches to about 55 inches, or from about 40 inches to about 50 inches. For example, according to various embodiments, standup paddle board 100, in FIGS. 1A-1C, can comprise a length "L" of about 126 inches, a width "W" of about 42 inches, and a thickness "T" of about 6 inches.

Advantageously, a standup paddle board comprising a substantially rectangular plane shape, according to various embodiments of the present teachings can, in use on a body of water, support at least about 800 lbs. of weight on its deck and remain substantially buoyant and stable.

According to various embodiments, a plurality of attachment or connection points can be provided along the periphery of a board's deck, to which one or more elongate link members, further described below, can attach. In various embodiments, for example, a connection point can comprise a D-ring attached along the periphery of a board. According to some embodiments, a connection point can comprise a cleat attached along the periphery of a board. In various embodiments, a connection point can comprise a hook-and-loop type fastening component attached along the periphery of the board.

Connection points can be provided along the periphery of one, two, three, or all four sides of a substantially rectangular standup paddle board, in accordance with various embodiments of the present teachings. For example, in some embodiments, plural pairs of like or similar connection points, e.g., D-rings, are provided along opposing side regions of the board; e.g., (i) along the periphery of the deck's left and right lateral side regions, and/or (ii) along the deck's periphery at the board's nose and tail. In the depicted embodiment of FIGS. 1A-1C, for example, eight (8) pairs of connection points, denoted at 112, are disposed at regularly spaced locations along the periphery of each lateral side region, 108L and 108R, of standup paddle board 100, with four pairs on each side.

Figure 2:
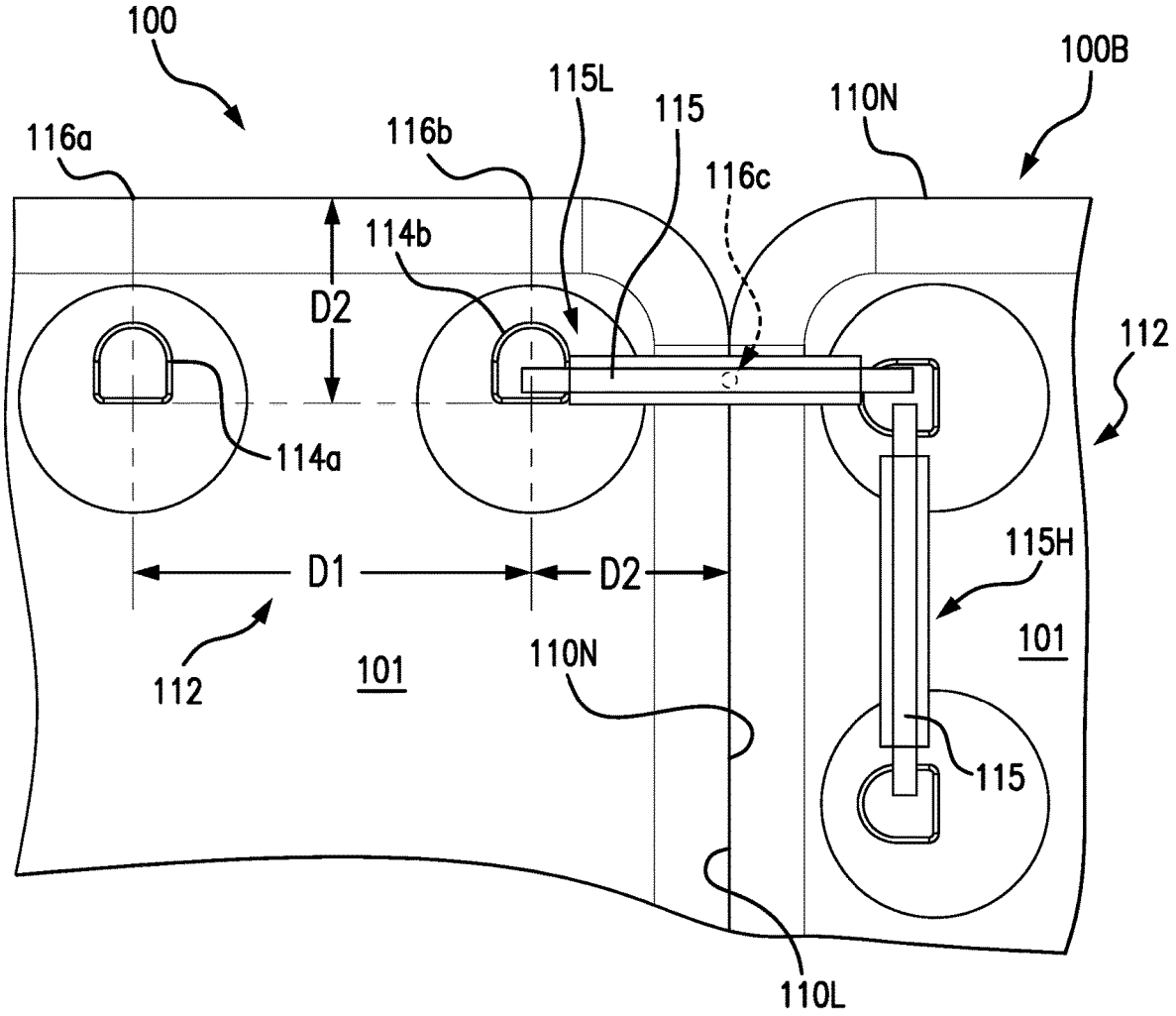
FIG. 2 schematically illustrates, in partial top plan view, adjacent regions of first and second similarly-configured stand-up paddle boards, each like that shown in FIGS. 1A-1C, disposed side-by-side and a respective elongate link member of each board, with one board's link member configured to function as a handle for the board and the other board's link member configured as a linkup connecting and maintaining the two boards together in abutting side-by-side relation; in accordance with various embodiments.

Referring now additionally to FIG. 2, according to various embodiments, a pair of connection points, denoted at 112, is disposed on the deck 101 of standup paddle board 100. In the depicted embodiment, the connection-point pair 112 comprises first and second individual connection points or members, such as first and second D-rings, denoted 114*a* and 114*b*, respectively. In FIG. 2, D-rings 114*a* and 114*b* are separated from one another by a distance, "D1", and each D-ring itself (114*a*, 114*b*) is separated from at least one respective nearest point of the board's perimeter (denoted at 116*a*, 116*b*, respectively) by a distance, "12". As can be seen in FIG. 2, D-ring 114*b*, disposed at a corner region of deck 101, is separated by distance D2 from two separate points on the board's perimeter, with one such point at 116*b*, along a nose rail 110N of the board, and the other at 116*c* (phantom line), along a left lateral side rail 110L of the board. According to various embodiments, the distance D is at least twice the distance D2. In various embodiments, for example, the distance D1 is substantially equal to the distance D2.

According to various embodiments, one or more elongate link members can be provided for use with a standup paddle board of the present teachings, with each link member comprising first and second end regions. In various embodiments, one end region of the link member can attach at a first connection point of a connection-point pair on the deck, and the other end region can be adapted for manual movement by a user between a first position, attaching at a second connection point of the connection-point pair, and a second position, extending away from the deck along a line defined by the first connection point and the first connection point's respective nearest point of the board's perimeter. By such arrangement, the elongate link member can provide, in its first position, a handle for the board; and, in its second position, a linkup for connecting the board to an adjacent like or similarly configured stand-up paddle board.

With continuing reference to FIG. 2, for example, an elongate link member 115 attaches at one of its end regions to one D-ring of a D-ring pair, as at 112, attached to a peripheral region of the deck of a standup paddle board (100, 100B). Link member 115 is adapted to function, in a first configuration, indicated at 115H in FIG. 2, as a handle for carrying, holding, or otherwise manipulating the standup paddle board to which both its end regions attach; and, in a second configuration, indicated at 115L in FIG. 2, as a linkup for connecting standup paddle board 100 in abutting relation with one or more other adjacently located, like or similarly configured standup paddle boards, such as board 100B in FIG. 2. Such abutting relation between adjacent standup paddle boards can be, for example, side-by-side, end-to-end, side-to-end, or any combination thereof, depending upon the number of boards employed and the overall geometric configuration desired.

It is noted that various embodiments contemplate plural link members disposed along the periphery of a standup paddle board's deck at one or both of its nose region and/or tail region, in addition, or as an alternative to one or more link members disposed along the left and/or right lateral side regions of the standup paddle board.

In various embodiments, a link member of the present teachings comprises an elongated member, such as a web, belt, strap, cord, band, line, rope, rod, or the like, comprising a tensile strength sufficient to substantially stabilize two or more connected standup paddle boards under a range of conditions/forces typically encountered on recreational bodies of water (e.g., waves, wakes, chop, flow, etc.). In various embodiments, the link member can comprise, for example, an elongate, flat nylon strap comprising a width, e.g., within a range of from about 0.5 inch to about 1.0 inch. In some embodiments, a linkup member comprises a 1-inch wide, flat nylon strap comprising breaking strength of at least about 250 lbs. By employing multiple link members in a linkup configuration connecting two boards together along abutting respective borders, multiples of such tensile strength can be achieved. For example, employing four such link members in this way, a breaking strength of at least about 1,000 lbs. is provided.

In some embodiments, a link member of the present teachings additionally comprises strength in one or both of compression and torsion to further stabilize two or more connected standup paddle boards under such conditions/forces. In various embodiments, for example, a link member of the present teachings comprises a substantially rigid elongate rod, cylinder, beam, or the like, comprising a metal material. In some embodiments, a link member is comprised of a stainless-steel rod enveloped by (e.g., sewn into) an elongate web of material, such as nylon. In some embodiments, for example, one or both ends of the elongate web can attach at connection points on a board's deck, as desired, with the enveloped rod lending strength in compression and/or torsion to the link member.

As described above, according to various embodiments, a pair of attachment points can comprise adjacent D-rings attached along the periphery of a board. In some embodiments, a link member can comprise, for example, an elongate strap with one end attached to a female buckle and the other end fit into a cinch-type mating male buckle. The strap can be passed through each of the two adjacent D-rings and then the ends of the strap brought together at a point between the D-rings, where the male buckle can be releasably locked into the female buckle. An end of the strap that is threaded through the cinch buckle can be pulled to remove slackness out of the strap. The cinch buckle can then engage and hold the strap to maintain it in a tightened position and at a desired length. For example, the cinch buckle can include a locking cam, teeth, or the like, for grabbing the strap, once tightened, and preventing subsequent slippage.

In various embodiments, a sleeve is provided that can wrap around a tightened link member, e.g., an elongate strap with attached interlocking buckles, along a region extending between adjacent connection points, and then be held closed, for example, via interlocking hook and loop fastening components provided on adjoining surfaces of the sleeve.

As described above, according to various embodiments, a pair of attachment points can comprise adjacent cleats attached along the periphery of a board. In some embodiments, a link member can comprise an adjustable length strap having a loop at each end configured to fit over a respective one of the cleats. Once each such loop has been engaged with its respective cleat, the strap can then be cinched or pulled tight to remove slack. Then, the strap can be fixed or locked in place at a desired length. (See, e.g., U.S. Pat. No. 5,398,634 and U.S. Patent Publication Nos. US 2005/0061223 and US 2008/0196650; each incorporated herein by reference.)

In various embodiments, a link member is attachable to a standup paddle board of the present teachings using hook and loop straps, e.g., with pull handles. In some embodiments, a link member comprises an adjustable strap assembly utilizing hook and loop as the primary adjustment means. (See, e.g., U.S. Pat. No. 6,449,815; incorporated herein by reference.)

In operation, a user can tighten a linking member connecting two boards together so that a rail of one board pressingly engages an adjacently located rail of the other board. The tightened linking member can constrain relative movement between the connected boards. For embodiments providing compliant or resiliently deformable rails, the compressibility of the rails can provide cushioning between the connected boards. Further, such compressibility can assist in keeping tension in the link member, despite relative movement that may occur between the connected boards, such as due to waves, wakes, chop, etc.

Figure 3:
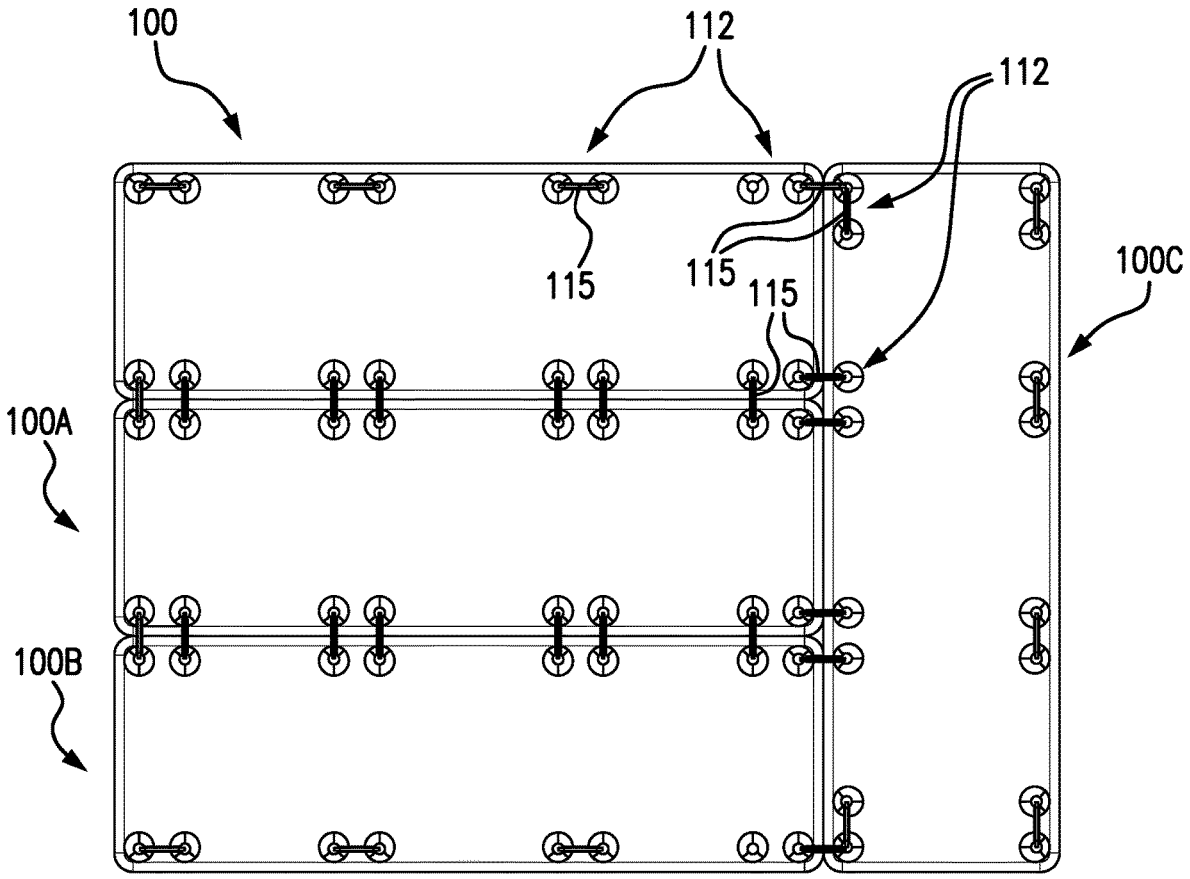
FIG. 3 schematically depicts, in top plan view, four similarly configured standup paddle boards, each like that shown in FIGS. 1A-1C, with each comprising a length-to-width ratio of three-to-one (3:1), disposed in abutting side-by-side and side-to-end configurations to provide an expanded upper surface or deck for engaging in various activities comprising the combined surface area of all four decks; in accordance with various embodiments.

FIG. 3 schematically depicts four similarly configured standup paddle boards 100, 100A, 100B, and 100C, each comprising a length-to-width ratio of 3:1, disposed in side-by-side and side-to-end configurations, employing connection-point pairs 112 and link members 115 in accordance with the present teachings, and an expanded upper surface or deck for engaging in various activities comprising the combined surface area of all four decks. Particularly, as illustrated, three of the boards, 100, 100A, and 100B, are disposed parallel to one another, in side-by-side abutting relation, and a fourth board, 100C, is disposed perpendicular to the other boards, in side-to-end abutting relation. Attention is drawn to the way the length of the perpendicular board equals the combined widths of the three parallel boards. Such configuration flows from the three-to-one (3:1) length-to-width ratio employed for each of the boards depicted in FIG. 3.

As described above, in various embodiments, stand up paddle boards of the present teachings can comprise a substantially rectangular overall outline or plane shape. It will be appreciated that such configuration can provide, for example, a substantially continuous extended upper surface when two or more such boards are securely connected to one another in abutting relation via link members of the present teachings. That is, an extended deck or upper surface is formed upon securely connecting plural standup paddle boards in side-by-side, end-to-end, and/or side-to-end abutting relation, according to the present teachings, comprising the combined deck surface area of all the respective plural boards employed.

According to various embodiments of the present teachings, undesired gaps, voids, and the like, existent between adjacent connected boards can be reduced or eliminated by way of a covering disposed over any such regions. Such covering can comprise, for example, a fabric, foam, or other suitable material. In some embodiments, undesired gaps, voids, and the like, between adjacent connected boards are reduced or eliminated via a resiliently compliant member, such as an elongate foam member, attached to and wrapped around the rails of the board. In other embodiments, inflatable construction techniques are employed, such as drop stitch or other known inflatable methods, to provide side rails that reduce or avoid gaps, voids, and the like, between adjacent connected standup paddle boards.

As previously described, the four corners of a substantially rectangular standup paddle board can be sharply curved or rounded via a small radius, thereby avoiding sharp corners. In various embodiments of the present teachings, the radius defining such corners is minimized to reduce the size of gaps, voids, and the like, between adjacent connected boards and so maximize the substantially continuous extended upper surface area collectively defined by the respective decks of the securely connected abutting boards.

Some embodiments of the present teachings provide means for providing rails of a standup paddle board with a desired contour or geometric shape, such as substantially planar or flat, curved, angled, or a combination thereof. In this regard, according to various embodiments, a standup paddle board can be outfitted with a semi-rigid, resiliently deformable, non-inflatable rail cap. For example, a rail cap in accordance with various embodiments of the present teachings can be configured on one of its sides for attachment over the native edges of a board, and on its opposing side to present an environment-facing surface of a desired shape or profile. In various embodiments, the rail cap is sufficiently rigid to substantially maintain its shape when the board is uninflated. Further, in various embodiments, the rail cap is resiliently deformable such that it substantially returns to its original shape after being compressed. The rail cap can be made, for example, using injection molding techniques. Attachment of the rail cap to/over the native edges of the board can by effected by any suitable means, e.g., adhesive.

Boards according to the present teachings can be manufactured by any suitable manufacturing method(s) known in the art. Suitable manufacturing methods contemplated herein include, for example: rotational molding, vacuum forming, thermal forming, blow molding, injection molding, foam laminate, foam fiberglass composite, epoxy or polyester resin layup, wood, metal, inflatable construction techniques such as drop stitch, stitch and glue, inflatable water craft manufacturing techniques and materials, foam with wood stringers, computer numerically controlled machining, and other composite and fiber lamination methods and variations known to those skilled in the art.

In various embodiments of the present teachings, for example, a stand-up paddle board comprises an inflatable board made using drop stitch techniques and materials. For example, the board can comprise a top panel and a bottom panel secured together by drop-stitching, and side panels extending between the top and bottom panels. Together, the top panel, bottom panel, and side panels define an interior volume of the board and can be sealed over the drop stitch construction.

According to some embodiments, plural drop stitch chambers are provided for a standup paddle board. For example, three separate drop stitch chambers can be provided for the board. Two drop stitch chambers on the sides or rails of the board can be provided with drop stitch fibers perpendicular to a main board drop stitch chamber. This creates two rigid rails of the board providing a higher performance and stiffer board. Additionally, this creates separate air chambers on each side of the board which can be inflated to a selected pressure that can be the same as, or different from that of the main board chamber. This allows the user to select how ridged or flexible they desire the sides or rails of the board to be. For example, the pressure can be set lower to provide a soft side or rail that wraps around the perimeter edges, or the air pressure can be inflated higher to create a ridged and higher performance inflatable board. Additionally, in various embodiments, the three air chambers can provide a backup feature in the event one deflates, e.g., due to a puncture or leak, as then there are two remaining chambers to enable continued floating.

In various embodiments of the present teachings, a paddle is provided as part of a system to connect multiple boards together, and which provides for stowing the paddle out of the way so as not to obstruct an extended upper surface or deck comprising the collective upper surface area of plural connected standup paddle boards. In various embodiments, the paddle can function as a substantially rigid link member to connect the boards by snapping into corresponding fittings provided on each board. This provides a strong and rigid link between boards while storing the paddle in a manner that keeps it secure and out of the way.

Various embodiments of the present teachings leverage the design of a substantially rectangular deck over a streamlined hull, such as a mono hull, a catamaran or a trimaran, to allow for significant volume for built-in compartments to function as dry storage, wet storage and ice chest, live bait well, equipment storage, and the like. In some embodiments, the storage volumes are provided with drain holes to prevent water from flooding the compartment and building up excess weight in the board. Various embodiments utilize water resistant lids to prevent water from entering the storage volume to provide a dry storage compartment.

In various embodiments, links can be used for transportation as carry handles and for securing multiple boards together. This can be useful, e.g., for shipping boards to customers and for users to transport the boards to different areas for use. Often standup paddle boards are transported by users on roof racks due to the long length typical of standup paddle boards (e.g., 9 ft. or more). Various embodiments of the present teachings employ a thin and stackable design that allow for multiple boards to stack together for storage and transport. In various embodiments, the links can be used to connect boards together to allow for a simplified tie down method on a trailer or roof rack to facilitate transportation of multiple boards.

Various embodiments of the present teachings provide for integrated equipment storage with removable lids. This can find use, for example, with anchor and rope/chain storage and organization. Various embodiments of the present teachings provide a formed cavity with removable lid, which a user can walk on when in place, to store the anchor, rope and buoy.

Additionally, in various embodiments, integrated fishing tackle boxes can be stored inside a cavity of the board which uses a removable lid to allow the user to walk over the storage compartment when closed.

Additionally, in various embodiments, a cavity with a dry bag and removable lid is provided to store a user's small personal items, such as car keys, sunscreen, wallet, sunglasses, and the like.

Various embodiments of the present teachings provide an integrated cup holder cavity with a removable cover. In various embodiments, a removable cover fits the cup holder cavity that a user can walk on when in place.

Various embodiments of the present teachings provide a cavity or hole in the board with a removable cover to allow for fishing poles to be stored in a useful position, e.g., for trolling while paddling. In various embodiments, for example, a cavity is configured to position a fishing pole at a slight angle to keep the line away from the paddling area while still keeping the pole in reach of a user to quickly pick up the pole, as needed.

Various embodiments of the present teachings provide for paddle storage so that the paddle is not an obstacle to one or more users walking across an extended deck, when multiple boards are connected. For example, in various embodiments, a paddle can snap into a cavity formed in the board rather than being placed on top of the board's surface. In some embodiments, a telescopic paddle is provided.

Various embodiments of the present teachings provide a dog traction pad and leash dog water bowl. In various embodiments, the water bowl is configured similarly to the above-described cup holder with removable cover.

Figure 4A:
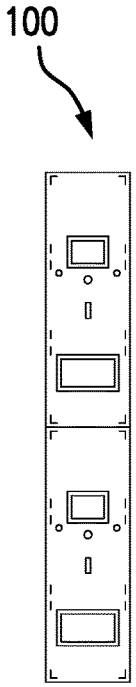
FIGS. 4A-4C schematically depict, in top plan view, a plurality of like-configured standup paddle boards connected in abutting relation via respective link members in (i) an end-to-end configuration (FIG. 4A), (ii) a side-by-side configuration (FIG. 4B), and (iii) a configuration comprising a combination of end-to-end and side-by-side linkup connections (FIG. 4C), with each configuration providing an expanded upper surface or deck for engaging in various activities comprising the combined deck surface areas of all the depicted boards; in accordance with various embodiments.
Figure 4B:
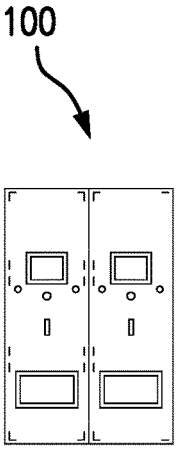
Figure 4C:
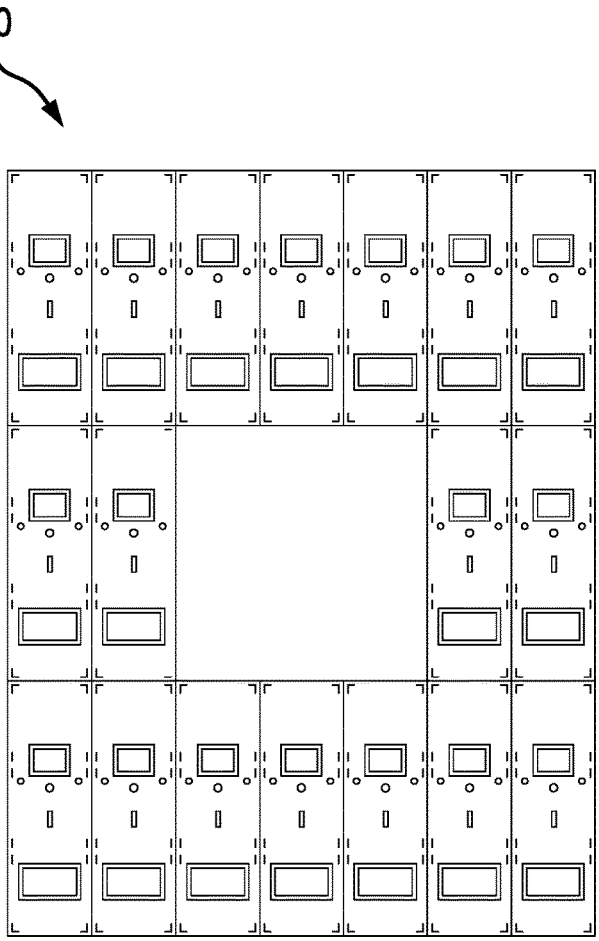

FIGS. 4A-4C schematically depict, in top plan view, a plurality of like- or similarly-configured standup paddle boards connected in abutting relation via respective link members (not shown in FIG. 4) in (i) an end-to-end configuration (FIG. 4A), (ii) a side-by-side configuration (FIG. 4B), and (iii) a configuration comprising a combination of end-to-end and side-by-side linkup connections (FIG. 4C), with each configuration providing an expanded upper surface or deck for engaging in various activities comprising the combined deck surface areas of all the depicted boards; in accordance with various embodiments. Each board comprises connection points (not shown in FIG. 4) and elongate link members (not shown in FIG. 4), as described herein, which are used to obtain the depicted multi-board connected configurations.

In FIGS. 4A-4C, various compartments and other structural features, such as described above, are schematically depicted on the surface of each board. For example, such compartments and structural features can include one or more compartments and/or utility structures to store equipment, food, drinks, safety equipment, electronics, energy storage devices, solar panels, musical performances, propulsion devices, ice, cooking equipment, tools, utensils, and/or trash receptacles, while preserving the ability to engage in (i) group actives while multiple stand up paddles boards are connected together and (ii) individual paddling and activities when the standup paddle board is not connected to another stand up paddle board. In various embodiments, such compartments and/or utility structures, or covers therefore, are configured to be substantially flush with the surface of the deck, so as not to present an obstacle to one or more persons engaging in one or more activities upon the deck.

All references set forth herein are expressly incorporated by reference in their entireties for all purposes.

While the principles of the present teachings have been illustrated in relation to various exemplary embodiments shown and described herein, the principles of the present teachings are not limited thereto and include any modifications, alternatives, variations and/or equivalents thereof.

The invention claimed is:

1. A stand-up paddle (SUP) board, comprising:

(a) an elongate body comprising (i) a perimeter defining a substantially rectangular plane shape comprising a width dimension W and a length dimension L, wherein the length dimension L is a whole-number multiple N of the width dimension W; (ii) an upper surface defining a deck; (iii) a bottom defining a hull; and (iv) an edge extending along each side of said body, between said deck and said hull, defining rails;

(b) a connection-point pair disposed on said deck comprising first and second connection points separated from one another by a distance D1 and from respective nearest points of said perimeter by a distance D2; wherein the distance D1 is substantially twice the distance D2; and, (c) an elongate link member, comprising first and second end regions, with one end region attachable at said first connection point and the other end region manually movable between a first position, attached at said second connection point, and a second position, extending away from said deck along a line defined by said first connection point and its respective nearest point of said perimeter;

whereby, said elongate link member provides, (i) when in said first position, a handle for said board; and, (ii) when in said second position, a linkup for connecting the board to an adjacent like-configured stand-up paddle board.

2. The board of claim 1, wherein said whole-number multiple N comprises 3, or a greater whole number.

3. The board of claim 1, wherein said first and second connection points comprise D-rings.

4. The board of claim 1, comprising a plurality of said connection-point pairs disposed at spaced-apart locations on peripheral regions of opposing sides of said deck.

5. The board of claim 1, wherein said link member comprises an elongate strap comprising one end region attached to a female buckle and the other end region fit into a cinch-type mating male buckle.

6. The board of claim 5, wherein said strap comprises an elongate, flat nylon strap, comprising a breaking strength of at least 250 pounds.

7. The board of claim 1, wherein said rails are at least partially planar in profile.

8. The board of claim 1, comprising a plurality of elongate link members, with each comprising a first end region and a second end region; wherein at least one end region of each link member attaches to a respective connection point on the deck.

9. The board of claim 1, wherein said deck comprises a substantially planar surface.

10. The board of claim 1, wherein said rails include an elongate nose rail, an elongate tail rail, an elongate left lateral side rail, and an elongate right lateral side rail.

11. The board of claim 10, wherein said rails are resiliently deformable.

12. A system for connecting plural stand-up paddle (SUP) boards together to provide an extended upper surface for engaging in one or more activities; comprising: (a) first and second stand-up paddle (SUP) boards, each comprising (i) an elongate body comprising a perimeter defining a substantially rectangular plane shape comprising a width dimension W and a length dimension L, wherein the length dimension L is a whole-number multiple N of the width dimension W; an upper surface defining a deck; a bottom defining a hull; an edge extending along each side of said body, between said deck and said hull, defining rails; and (ii) plural connection-point pairs at spaced-apart locations on the deck, each pair comprising a first connection point and a second connection point separated from one another by a distance D1 and from respective nearest points of said perimeter by a distance D2; wherein the distance D1 is substantially twice the distance D2; and (b) plural elongate link members disposed on each board, each comprising first and second end regions, with one end region attachable at a first connection point of a respective connection-point pair and the other end region adapted for manual movement by a user between a first position, attached at a second connection point of the respective connection-point pair, and a second position, extending away from said deck, along a line defined by said first connection point and its respective nearest point of said perimeter; whereby, each elongate link member provides, when in said first position, a handle for the board, and, when in said second position, a linkup for connecting to the other board; and whereby, with said first and second boards disposed adjacent one another in abutting relation and connected together via a plurality of said link members, an extended upper surface is provided that can serve as a substantially stable platform upon which one or more persons can engage in one or more desired activities.

13. The system of claim 12, wherein said rails include an elongate nose rail, an elongate tail rail, an elongate left lateral side rail, and an elongate right lateral side rail.

14. The system of claim 13, wherein one of said rails of the first board abuts one of said rails of the second board, with the abutment being continuous along at least 90% of the length of the shortest of the two abutting rails.

15. The system of claim 14, wherein the abutment is continuous along at least 95% of the length of the shortest of the two abutting rails.

16. The system of claim 12, wherein each board comprises a whole-number multiple N of 3.

17. The system of claim 12, wherein said connection points comprise D-rings.

18. The system of claim 12, wherein each link member comprises an elongate strap comprising one end region attached to a female buckle and the other end region fit into a cinch-type mating male buckle.

19. The board of claim 18, wherein each strap comprises an elongate, flat nylon strap, comprising a breaking strength of at least 250 pounds.

20. The system of claim 19, wherein the deck of each board comprises a substantially planar surface.

* * * * *